US008919832B1

(12) United States Patent
Lynch

(10) Patent No.: US 8,919,832 B1
(45) Date of Patent: Dec. 30, 2014

(54) CHILD SAFETY DOOR LATCH

(76) Inventor: Graham Lynch, Melbourne (AU)

( * ) Notice: Subject to any disclaimer, the term of this patent is extended or adjusted under 35 U.S.C. 154(b) by 490 days.

(21) Appl. No.: 13/374,094

(22) Filed: Dec. 12, 2011

(51) Int. Cl.
*E05B 1/00* (2006.01)
*E05C 17/56* (2006.01)

(52) U.S. Cl.
USPC ..... 292/347; 292/32; 292/37; 292/140; 292/251.5; 292/DIG. 37

(58) Field of Classification Search
USPC ..... 292/32–34, 37, 38, 41, 42, 137, 138, 292/140, 141, 145, 251.5, 347, DIG. 37
See application file for complete search history.

(56) References Cited

U.S. PATENT DOCUMENTS

| | | | | | |
|---|---|---|---|---|---|
| 793,087 | A * | 6/1905 | McVitty | 70/214 |
| 2,000,111 | A * | 5/1935 | Weis | 70/214 |
| 2,046,342 | A * | 7/1936 | Muck et al. | 292/352 |
| 2,219,186 | A * | 10/1940 | Hornfeck | 292/144 |
| 2,473,065 | A * | 6/1949 | Miller | 292/37 |
| 2,547,546 | A * | 4/1951 | Stulpin et al. | 292/166 |
| 2,586,900 | A * | 2/1952 | Alderman | 292/74 |
| 2,742,314 | A * | 4/1956 | Santos | 292/336.3 |
| 2,880,606 | A * | 4/1959 | Clark | 70/214 |
| 3,206,238 | A * | 9/1965 | Speight et al. | 292/195 |
| 4,575,141 | A * | 3/1986 | Burns | 292/336.3 |
| 4,799,371 | A * | 1/1989 | Duncan | 70/214 |
| 5,360,243 | A | 11/1994 | Hirsh | |
| 5,785,363 | A | 7/1998 | Stopfer et al. | |
| 6,179,352 | B1 * | 1/2001 | Schneeberger | 292/347 |
| 7,273,242 | B2 * | 9/2007 | Godin Flott et al. | 292/347 |
| 7,766,399 | B2 * | 8/2010 | Howey | 292/251.5 |
| 8,100,443 | B2 * | 1/2012 | Talpe | 292/347 |
| 2009/0030427 | A1 | 1/2009 | Razvi et al. | |
| 2009/0266121 | A1 | 10/2009 | Craig | |

FOREIGN PATENT DOCUMENTS

| | | | |
|---|---|---|---|
| DE | 803698 | * | 7/1949 |

* cited by examiner

*Primary Examiner* — Carlos Lugo
(74) *Attorney, Agent, or Firm* — Harpman & Harpman

(57) ABSTRACT

A closure retainment latch for cabinet doors and the like that provides a child resistant access protocol restricting opening to required user specific actions. A cabinet door handle selectively engages an interior magnet retainer latch allowing the door to open. Multiple handle engagement indicated operations are required to initiate handle drive activation and latch release in a rotational longitudinally engagement configurations of contoured interdependent engagement activation elements within the handle and latch specific cam engagement surfaces.

4 Claims, 9 Drawing Sheets

CHILD SAFETY DOOR LATCH

BACKGROUND OF THE INVENTION

1. Technical Field

This invention relates to safety devices for door latches to restrict access by children, specifically cabinets and cupboards.

2. Description of Prior Art

Prior art devices of this type have been directed towards a variety of profile locks and handles wherein children are unable to open the door by the usual handle rotation and latch movement associated therewith.

Such prior art devices can be seen, for example, in U.S. Pat. Nos. 5,360,243, 5,785,363 and U.S. Publications 2009/0030427 and 2009/0266121.

In U.S. Pat. No. 5,785,363 a child safety latch can be seen having a dual activation push button configuration wherein both the buttons must be pushed and held simultaneously to activate release of the engagement of an interior latch.

U.S. Pat. No. 5,360,243 claims a latching structure for use with cabinets having electromagnetic member to engage a latch member. A switch provides activation and release of the mechanical latch allowing the cabinet to be open.

U.S. Patent Publication 2009/0030427 A1 illustrates a control handle for a lock wherein a release button is slidably advanced and held to directly engage a shaft or door latch retraction allowing the door to open.

U.S. Patent Publication 2009/0266121 A1 shows a child proofing of a door latch that is adapted to a standard lock set that prevents the door knob from turning when engaged. A sliding plate holds a locking post in place with a notch preventing the door knob rotation unless disengaged by a control lever interengaged therewith.

SUMMARY OF THE INVENTION

A cupboard safety latch device that provides a handle and interior release mechanism which requires multiple user actions to activate and release for access. The handle having a secondary movable element that interconnects rotatable handle input with an interior magnetic release by interlocking drive elements. Two movements are user required both handle rotation and simultaneous button depression to achieve inner latch and interior release engagement.

DETAILED DESCRIPTION OF THE INVENTION

Figure 1:
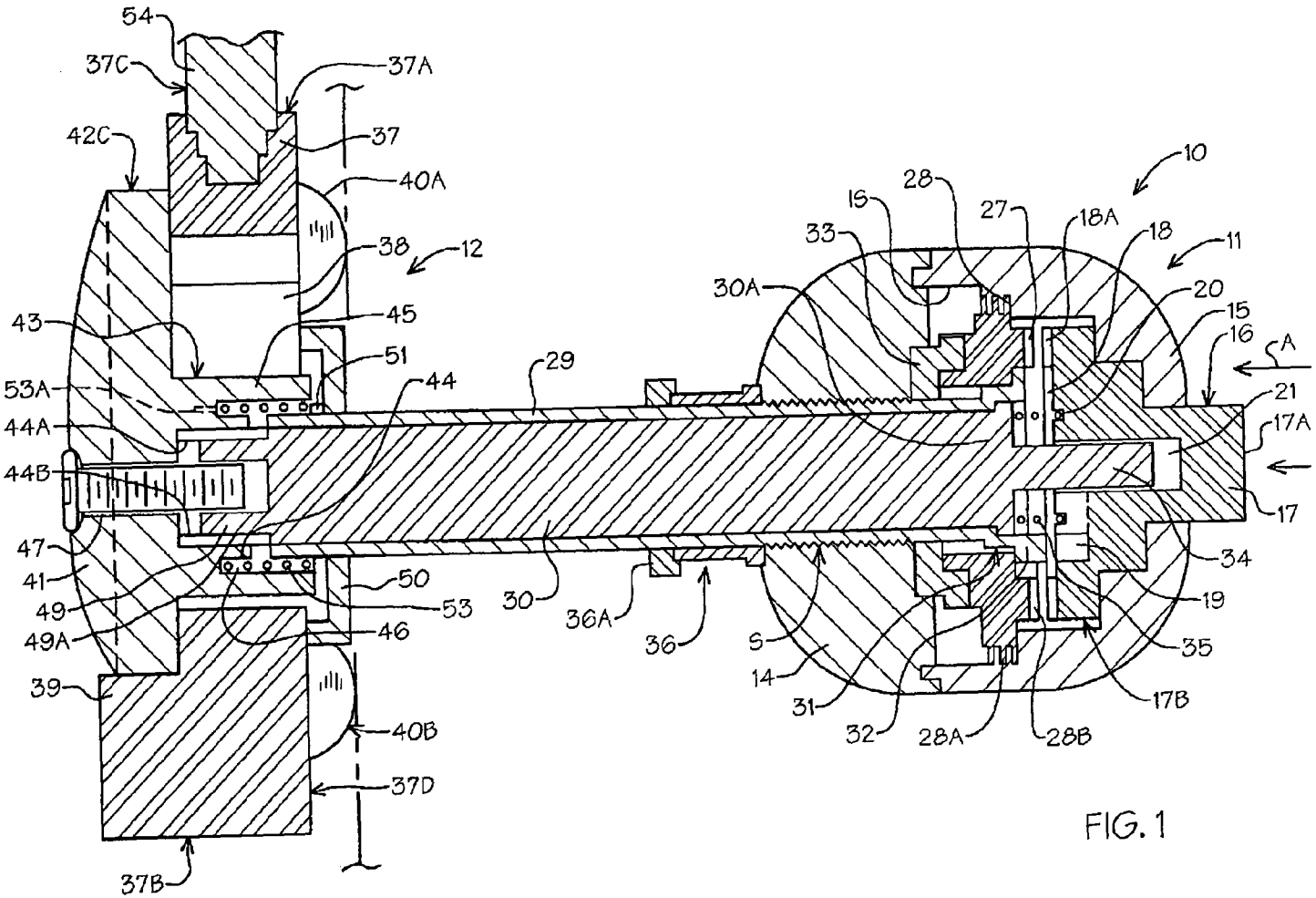
FIG. 1 is a sectional view of the invention assembly with portions broken away.
Figure 2:
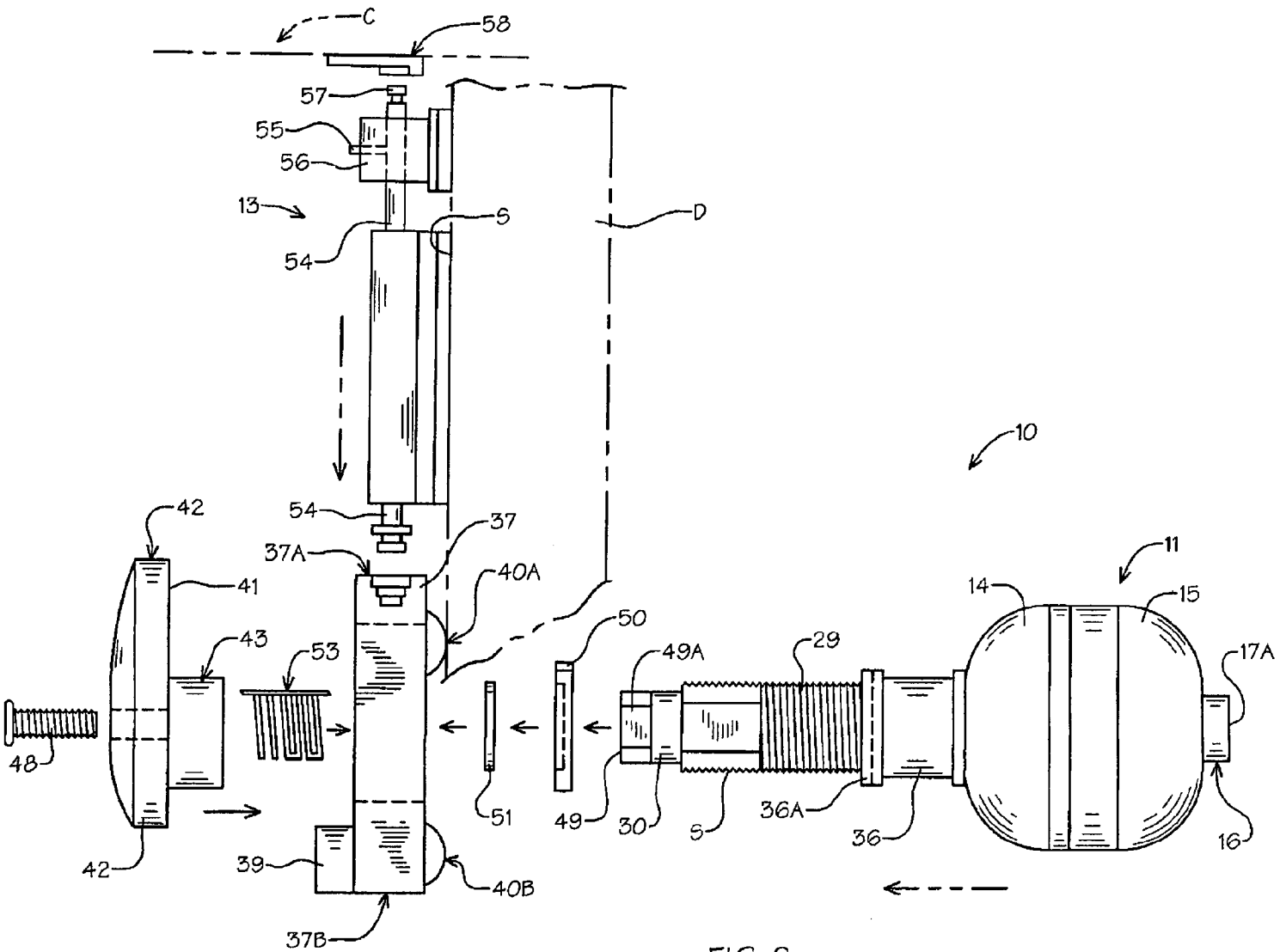
FIG. 2 is an exploded side elevational accessible view thereof.
Figure 3:
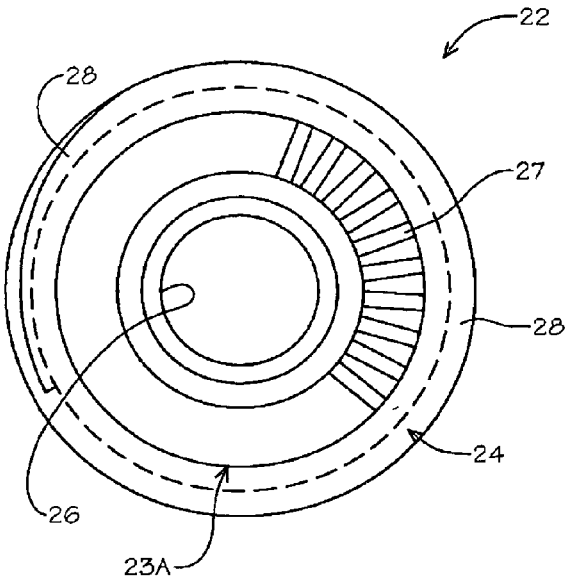
FIG. 3 is a front elevational view of a drive lock element in the handle thereof.
Figure 4:
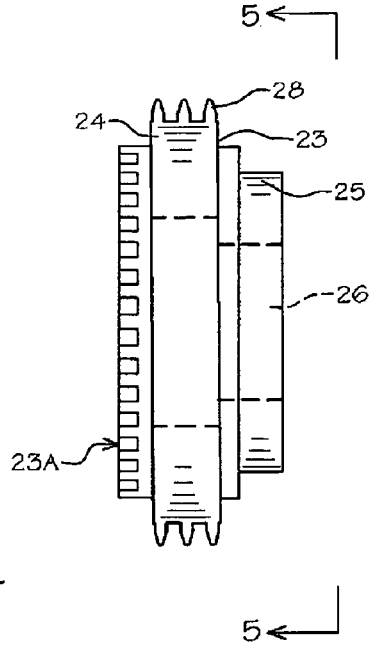
FIG. 4 is a side elevational view thereof.
Figure 5:
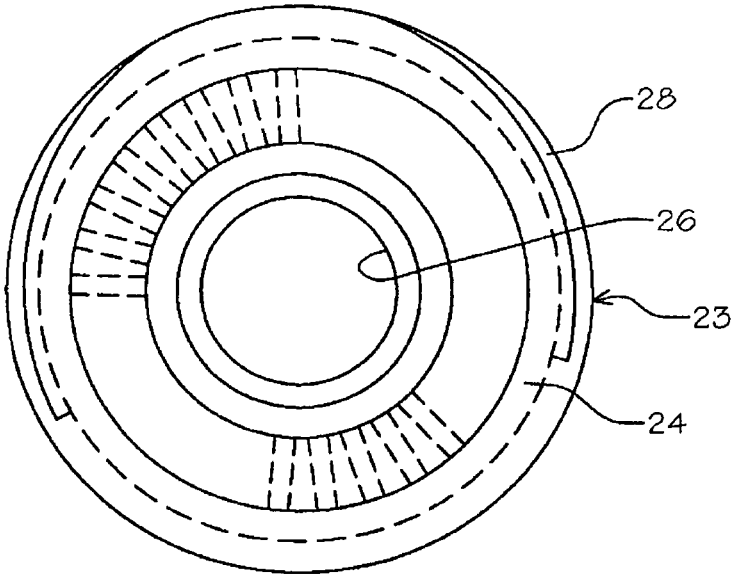
FIG. 5 is on lines 5-5 of FIG. 4.

Referring to FIGS. 1 and 2 of the drawings, a safety door latch 10 of the invention can be seen having a handle assembly 11, a cam rod release assembly 12 and a rod latch assembly 13. The handle assembly 11 has two-part handle housing 14 and 15 respectively with a spring driven activator control button 16 which must be pushed in while the handle is being turned as will be described in greater detail hereinafter for operational engagement.

Figure 6:
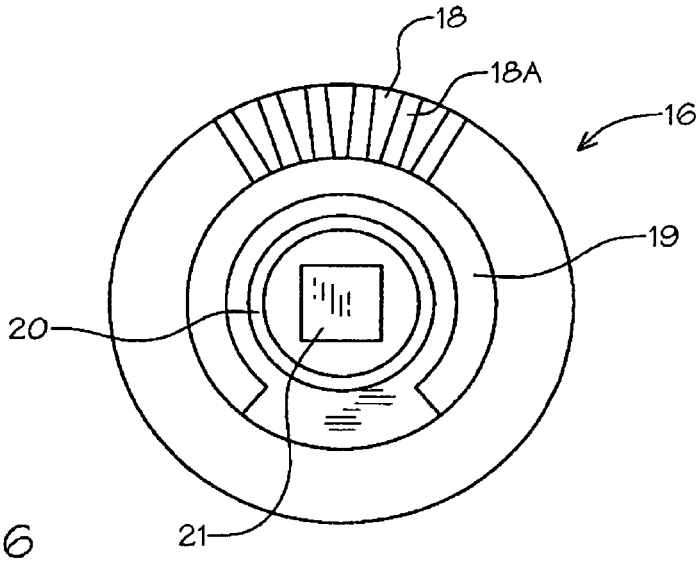
FIG. 6 is front elevational view of an activation button in the handle thereof.
Figure 7:
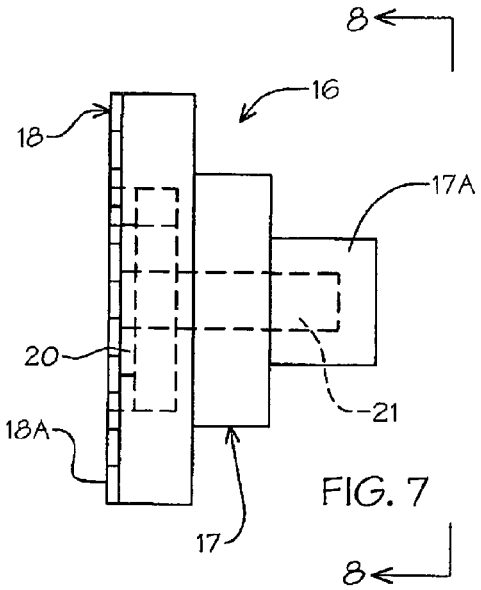
FIG. 7 is a side elevational view thereof.
Figure 8:
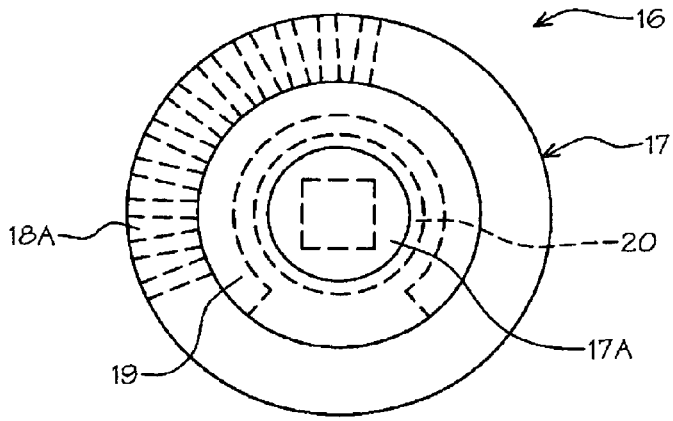
FIG. 8 is on lines 8-8 of FIG. 7.

The control button 16, best seen in FIGS. 1, 6, 7 and 8 of the drawings has a main stepped annular body member 17 with a user end engagement portion 17A and drive engagement portion 17B. The drive portion 17B has an annular gear surface 18 with a plurality of radially spaced teeth 18A thereon. A rotational limitation engagement channel 19 extends partially within the control button 16's main body member and an annular spring seat 20 in spaced relation thereto as best seen in FIG. 6 of the drawings. A centered drive shaft receiving cavity 21 extends partially therewithin providing an engagement surface as will be described.

A drive lock fitting 22, best seen in FIGS. 1, 3, 4 and 5 of the drawings has a stepped annular body member 23 having a gear portion 23A, a housing engagement portion 24 and a nut engagement portion 25 with a central bore at 26 extending therethrough. The gear portions 23A has a plurality radially spaced teeth 27 for select engagement with the teeth 18A on the button 16. The housing engagement portion 24 has annular threads 28 extending therefrom for registration with corresponding threads 28A on the inner surface IS of the housing part 15 as best seen in FIG. 1 of the drawings.

As assembled, the drive lock fitting 22 is rotatably positioned on a drive shaft housing 29 having a central drive shaft 30 therewithin and extending therefrom as will be described in greater detail hereinafter.

Figure 9:
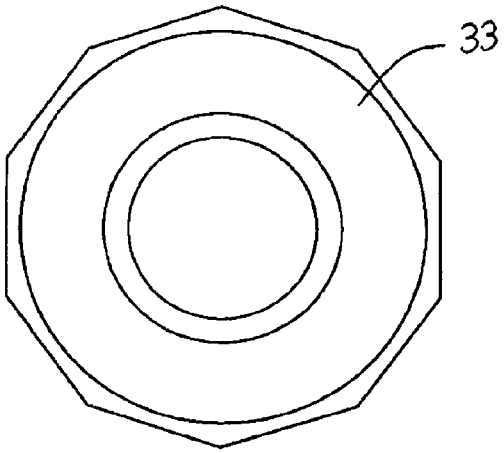
FIG. 9 is a front elevational view of a locking nut.
Figure 10:
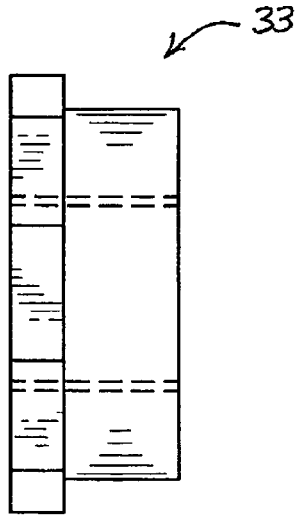
FIG. 10 is a side elevational view thereof.
Figure 11:
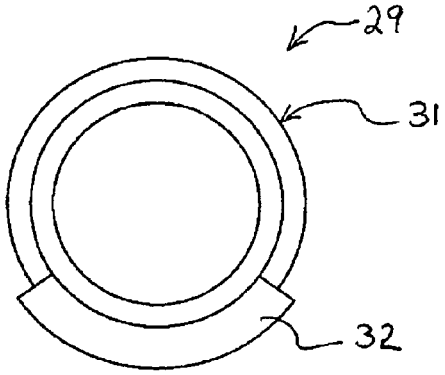
FIG. 11 is a front elevational view of the drive shaft and sleeve of the invention.
Figure 12:
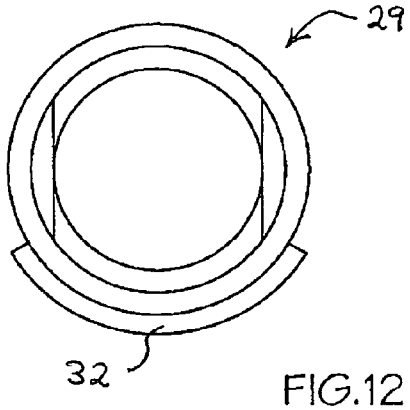
FIG. 12 is a rear elevational view thereof.
Figure 13:
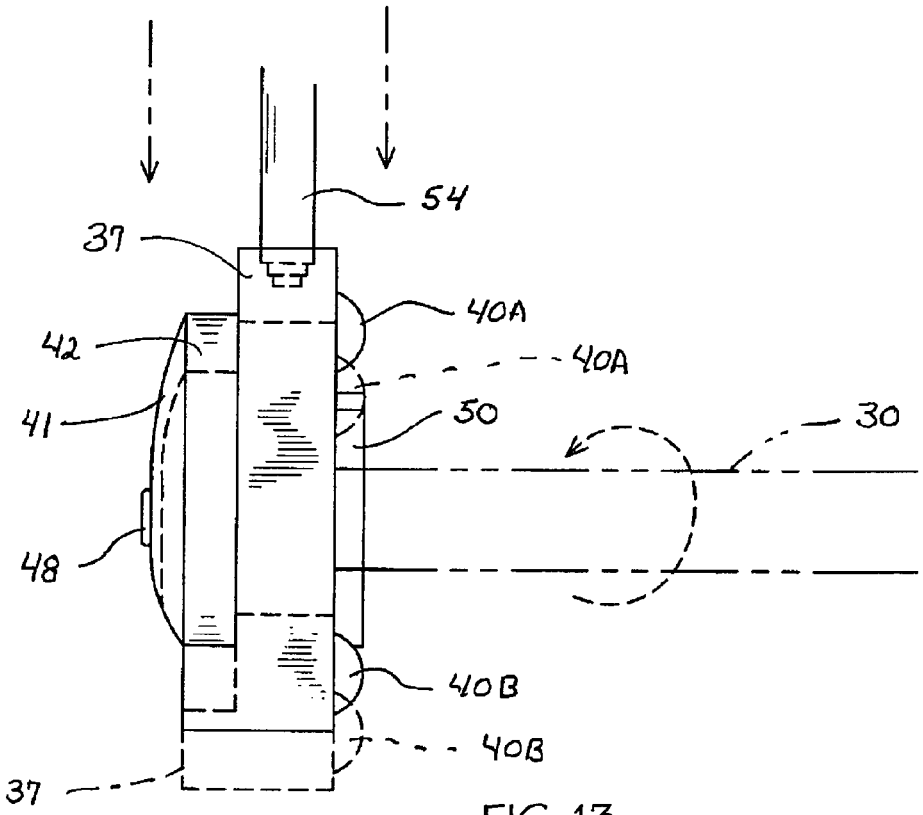
FIG. 13 is a side elevational view of a cam release activation rod assembly of the invention.

The drive shaft housing 29 is cylindrical having a threaded exterior surface S with a compound smooth annular flange end 31 from which extends a rotational restriction about stopper bar 32 as best seen in FIGS. 1 and 11 of the drawings. The drive lock fitting 22, as noted, slips over the drive shaft housing 29 and abuts against the end flange 31 and is retained thereagainst by a drive lock nut 33, best seen in FIGS. 1, 9 and 10 of the drawings. The drive shaft 30 has a corresponding retainment flange 30A in retaining registration with the hereinbefore described flange end 31 of the drive shaft housing 29. The drive shaft 30 has an area of reduced transverse dimension 34 extending from the flange end 31 of the drive shaft housing 29 registering within the shaft receiving cavity 21 of the button 16. A spring 35 in the spring seat 20 extends about a portion of the drive shaft extension 34 and against the drive shaft 30 imparting a resilient action to the button 16 during use.

Referring now to FIG. 1 of the drawings, the handle housing 15 can be seen having an interior annular stepped configuration corresponding to an exterior stepped surface of the button 16 and with the drive lock fitting 22 aligning same to afford selective button gear teeth 18A and drive lock fitting 22 gear teeth 27 for selective engagement indicated by directional arrows A upon button 16 displacement within the handle housing portion 15 when in assembly as shown in FIG.

1 of the drawings. The handle housing 14 rotatably supports the drive shaft housing 29, drive shaft 30 therein and threaded engagement lock nut 33, as assembled.

A handle spacer 36 and spacer lock retaining nut 36A are threadably secured on the drive shaft housing 29 retaining the handle housing 14 for adjustable resistant rotation thereon.

The handle assembly 11 as hereinbefore described will provide for select operational rotation of the drive shaft 30 in the following user sequence.

The handle housings 14 and 15 can be freely rotated independently on the drive shaft assembly in non-engagement position illustrated in FIG. 1 of the drawings, however, once the button 16 is depressed indicated by activation arrows A inwardly against the spring 35, the respective gear teeth 18A and 27A engage effectively locking the button 16 to the rotatable drive lock fitting 22 thereby rotating the drive shaft 30 keyed therewithin. The rotational restriction stopper bar 32 extending from the drive shaft flange housing end 32 as described is correspondingly registered within the rotational limitation engagement channel 19 limiting the effective drive shaft 30 and therefore handle rotation when so engaged and turned.

Referring now to the cam rod release assembly 12, best seen in FIGS. 1, 2, 13 and 14 of the drawings, the cam rod release assembly 12 has a rectangular activation frame 37, best seen in FIG. 1 of the drawings with oppositely disposed top and bottom surfaces 37A and 37B respectively and spaced parallel front and back surfaces 37C and 37D as positioned in this illustration. The frame 37 has a central contoured opening therethrough at 38 and elongated lug 39 extending from the so defined front surface 37C in co-planar relation to its bottom surface 37B.

Pairs of surface engagement arcuate guide feet 40A and 40B extend in spaced parallel opposing relation to one another from the so-defined back surface 37D of the rectangular activation frame 37.

Figure 14:
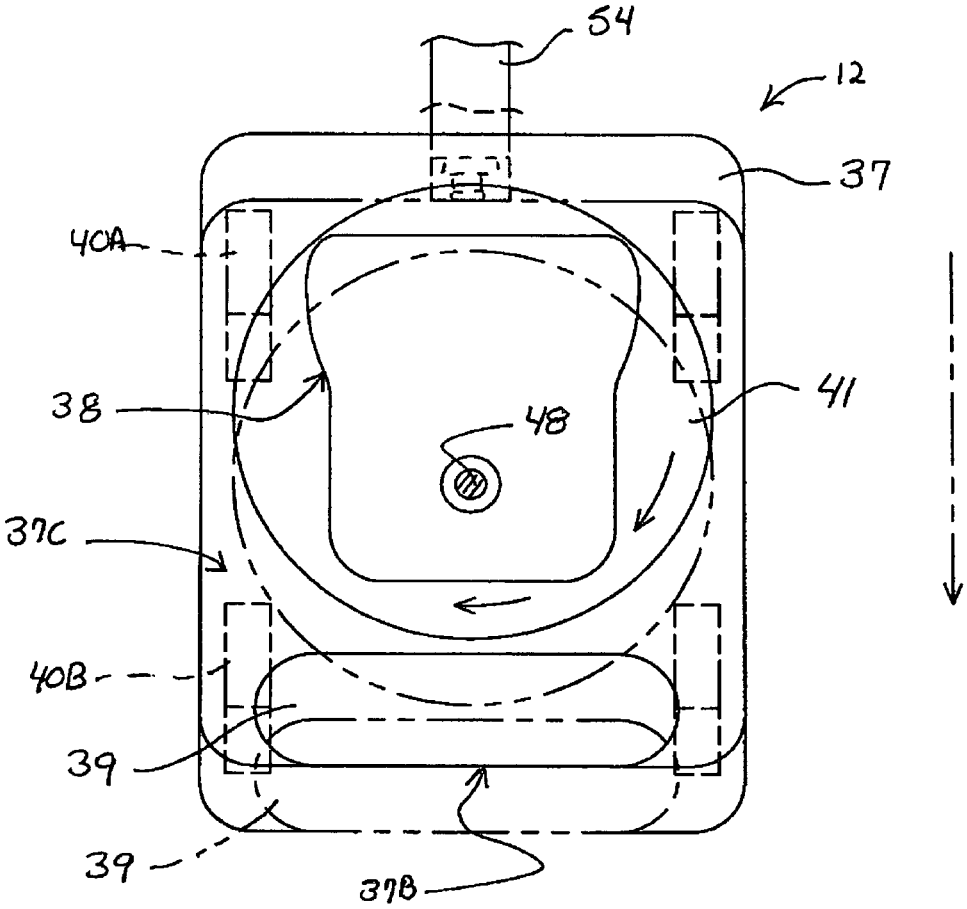
FIG. 14 is a front elevational view thereof.

A cam fitting 41 can be seen in broken lines in FIG. 14 of the drawings and best seen in solid lines in FIGS. 1 and 2 of the drawings, has a cam engagement surface 42 with an extending annular drive shaft engagement sleeve 43 having an interior annular sidewall 44 with oppositely disposed parallel interior key engagement surfaces 44A and 44B therewithin. An outer annular spaced sidewall 45 defines therefore a spring channel 46 therebetween with a central opening at 47 extending through the cam fitting providing access for a fastener screw 48 to engage within an apertured end 49 of the drive shaft 30.

The cam fitting 41 is registerable on the front surface 37C of the frame 37 so as to rest in non-activated position on top of the elongated lug 39 with the drive shaft support sleeve 43 therefore extending into the contoured opening 38 as shown in FIG. 1 of the drawings. The heretofore free end of the drive shaft 49 has a keyed surface extension of reduced transverse diameter 49A which is engaged in the inner annular sidewall 44 keyed engagement surfaces 44A and 44B when assembled.

An apertured retaining disk 50, see in FIGS. 1, 2, 16 and 17 of the drawings is provided with a disk lock nut 51 is secured to the drive shaft housing 29. The apertured retaining disk 50 has aligned spring engagement tabs 52 registerable against the outer sleeve 45. A return spring 53 is secured at 53A into the cam fitting 41 and extends between the respective inner and outer sleeves 44 and 45 being secured between the engagement tabs 52 of the retaining disk 50 so as to provide rotational spring return resistance to the cam fitting 41 when rotated by the drive shaft 30 during activation as hereinbefore described.

Referring back to FIG. 2 of the drawings the rod latch assembly 13 can be seen having a latch activation rod 54 secured in and extending from the top surface 37A of the hereinbefore described frame 37. A rod guide bracket 56 is provided and mounted on the door D assuring latch activation rod 54 retention and alignment. The bracket 56 has a grub adjustment screw 55 therein that when engaged stops the rod 54 from moving so the magnet fitting 58 cannot draw the rod 54 into the locked position. A ferrous metal plate 57 secured to the free end of the activation rod 54 and is magnetically engaged by a magnet retaining fitting 58 mounted on the interior surface of a cabinet C on which the door D, in this example, is positioned.

It will be evident that the engagement rod 54 orientation when retained by the magnet fitting 58 will prevent the door D from freely opening until the handle assembly 10 of the invention is properly activated.

In operation, once the button 16 is pressed and the handle 15 is rotated simultaneously, the drive shaft 30 so engaged will correspondingly rotate the cam fitting 41 engaging and "sliding the frame 37" on the inside of the door D thus pulling down in this illustrated orientation the activation rod 54 within the guide bracket 56 releasing same from the magnetic fitting 58. At this point, the door D can be opened by pulling the handle assembly 10 as will be well understood by those skilled in the art.

Figure 15:
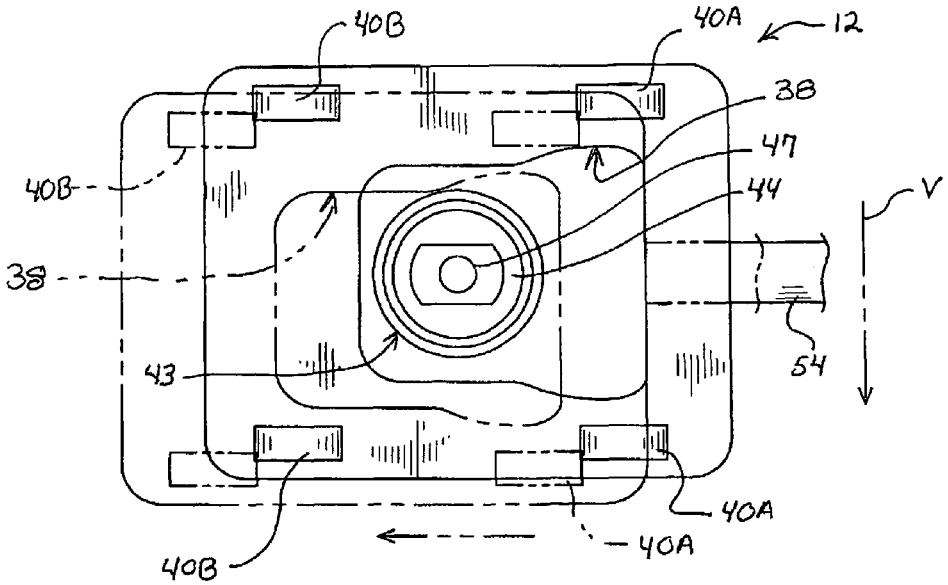
FIG. 15 is a partial rear elevational view of a horizontal mount of the cam release activation rod assembly.
Figure 16:
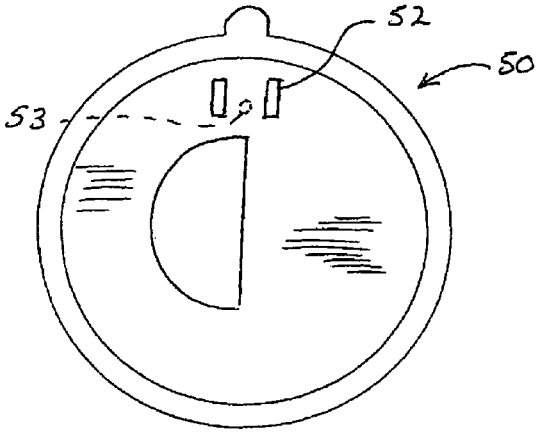
FIG. 16 is a front elevational view of a cam assembly retaining disk.
Figure 17:
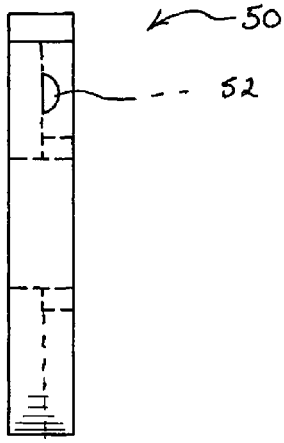
FIG. 17 is a side elevational view thereof.

As noted, the cam retaining spring 53 will return the cam fitting 41 once the handle 15 is released by the user, not shown. The rod 54 and frame 37 will remain in position and not return with the cam fitting 41 staying in the unlocked position until the magnetic fitting 58 can so engage and draw same to the lock as noted. It will be seen that the cam rod assembly 12 can be mounted in a horizontal orientation as shown in FIG. 15 of the drawings so as wherein the cam fitting 41 is rotated with the engagement sleeve 43 shown in solid lines. The frame 37 will be slid horizontally as indicated by broken lines and the sleeve 43 will slidably engage into the enlarged area of the contoured opening 38 and retain the frame 37 in the "open" position by frictional gravity at 59 as the frame 37 drops slightly down vertical indicated by broken arrow V as well as horizontally as noted, by broken arrow H.

It will be evident from the above description that unless the button 16 is depressed, engaging the drive lock fitting 22, that the handle 15 will just rotate without effective articulated latch release engagement.

It will thus be seen that a new and novel child safety door latch has been illustrated and described and it will be apparent to those skilled in the art that various changes and modifications may be made thereto without departing from the spirit of the invention.

Therefore I claim:

1. A control handle safety latch assembly for doors comprising, a handle rotatably mounted on a drive shaft assembly having a drive shaft rotatable in a supportive sleeve, annular flanges on one end of said supportive sleeve and a drive shaft in registerable engagement with one another and a drive lock fitting, a spring urged activation button extending from said handle, said drive lock fitting selectively engaged by said activation button interlocking said handle to said drive shaft rotating same, a plurality of gear tooth on said button, a cam and rod assembly having a cam fitting secured to and movable by said drive shaft in spaced relation to said handle engaged by said drive shaft, a magnetic latch which interacts with said cam rod assembly upon rotation of a cam element in said cam rod assembly, said drive lock fitting having a plurality of gear tooth for selective registration with said activation button.

2. The control handle latch assembly set forth in claim 1 wherein said activation button gear teeth are on an engagement surface of said button.

3. The control handle safety latch assembly set forth in claim 1 wherein said cam and rod assembly further comprises, a cam assembly retaining disk on said drive shaft assembly registerable against said cam engagement frame, a return spring secured between and to said cam fitting and said cam assembly retaining disk, a latch activation rod extending from said cam engagement frame, a latch element on a free end of said latch activation rod registerable with a fixed magnetic latch.

4. The control handle safety latch assembly set forth in claim 1 wherein said annular flanges on said support sleeve further comprise a rotation restrictive flange extending therefrom registerable within said activation control element upon activation thereof.

* * * * *